US006196135B1

(12) United States Patent
Kashima et al.

(10) Patent No.: US 6,196,135 B1
(45) Date of Patent: Mar. 6, 2001

(54) SHOCK ABSORBING UNDERFRAME STRUCTURE FOR RAILROAD CAR

(75) Inventors: Jun Kashima; Kozo Ueta; Yoshihiko Miura; Tomohide Saito; Shogo Okochi, all of Higashi-Osaka (JP)

(73) Assignee: Kinki Sharyo Co., Ltd., Osaka (JP)

( * ) Notice: Subject to any disclaimer, the term of this patent is extended or adjusted under 35 U.S.C. 154(b) by 0 days.

(21) Appl. No.: 09/222,694

(22) Filed: Dec. 29, 1998

(30) Foreign Application Priority Data

Apr. 17, 1998 (JP) ..... 10-108044
Aug. 4, 1998 (JP) ..... 10-220208

(51) Int. Cl.[7] ..... B61D 15/06
(52) U.S. Cl. ..... 105/392.5; 105/396; 428/118
(58) Field of Search ..... 105/392.5, 396, 105/413, 418, 419, 421, 456; 428/118, 593

(56) References Cited

U.S. PATENT DOCUMENTS 4,235,170 * 11/1980 Bauer ..... 105/402
4,364,482 * 12/1982 Dilg ..... 213/8
4,715,292 * 12/1987 Pavlick et al. ..... 105/456
4,803,108 * 2/1989 Leuchten et al. ..... 428/118
5,480,729 * 1/1996 Hattori et al. ..... 428/593
5,601,034 * 2/1997 Tao et al. ..... 105/423
5,660,116 * 8/1997 Dannawi et al. ..... 105/392.5
5,895,701 * 4/1999 Givoni ..... 428/118

* cited by examiner

*Primary Examiner*—S. Joseph Morano
*Assistant Examiner*—Lars A. Olson
(74) *Attorney, Agent, or Firm*—Vedder Price Kaufman & Kammholz

(57) ABSTRACT

For relieving the impact force of a collision and insuring passenger safety by building an easily destructible structure into a railroad car underframe, two transversally extending cross or end sills 21, 23 are disposed in parallel and longitudinally spaced apart relation at the front end of a railroad car underframe 1 and energy absorbing sills 61 adapted to absorb shock energy by undergoing wall buckling when subjected to a shock load exceeding a predetermined value from the front of the car is disposed between the cross beams.

6 Claims, 6 Drawing Sheets

SHOCK ABSORBING UNDERFRAME STRUCTURE FOR RAILROAD CAR

BACKGROUND OF THE INVENTION

1. Field of the Invention

The present invention relates to a shock absorbing underframe structure for railroad car use which relieves the shock of a collision.

2. Description of the Related Art

The conventional underframe of a railroad car is designed to relieve the stresses generated under various design loads such as vertical load, end-to-end compression load, torsional load, etc. within specification limits of strength so as to prevent plastic deformation. In addition, from rigidity considerations, the underframe is so designed that deformations under such loads will be within specified displacement values. This is a design concept with emphasis placed on strength and rigidity and constitutes a common practice in designing a railroad car frame structure inclusive of the underframe. It is a classical leading principle in the design of structures which is based on the password "acceptable if rugged".

However, in view of the comparatively high incidence of collisions, the recent railroad car specifications, particularly the specifications for light-weight streetcars represented by the low-floor articulated car call for "collision-destructibleness" in lieu of the time-honored "non-destructible" structure. This concept was proposed because, in the conventional "non-destructible" construction, the degree of damage to the front end of the frame structure on the occasion of a collision is low but, instead, the car undergoes a sudden stop or rebounds with the front end more or less intact and hence imposes a remarkably great acceleration-deceleration load on the passengers aboard to inflict serious and even fatal damages. Since, in such a mere "rugged" construction, the front end structure is hardly destroyed by a collision, the amount of shock energy that can be absorbed as the plastics train energy of the structure is considerably small so that the shock can not be effectively attenuated.

Designed to obviate the above disadvantages of the prior art structure in association with a collision , the present invention has for its object to provide a shock absorbing underframe structure for railroad car use which is characterized in that the shock of a collision is attenuated for protection of passengers through an "easily destructible" structure locally built into the underframe.

For the reasons mentioned below, the underframe of a railroad car must be a "non-destructible" structure withstanding predetermined magnitudes of vertical load, end-to-end compression load, torsional load, and car-end lifting load. It is also necessary that the underframe structure be readily adapted to a variety of cars varying in shock resistance load.

SUMMARY OF THE INVENTION

The shock absorbing underframe structure of the present invention, therefore, is characterized in that at least two of the cross beams or end sill extending along the width direction of a car are disposed in parallel and spaced apart relation in the longitudinal direction of the car and, in addition, energy absorbing sills adapted to absorb shock energy by wall buckling when subjected to an impact force beyond a predetermined value from the front end of the car are disposed. The above-mentioned predetermined value for shock energy can be varied according to the number and arrangement of said energy absorbing sills.

The preferred shock absorbing underframe structure of the invention is characterized in that, in addition to the above basal structure, a reinforcing panel (preferably an aluminum honeycomb panel) is disposed on each side of the energy absorbing sill.

The more preferred shock absorbing underframe structure of the invention is characterized in that, in addition to whichever of the above structures, said energy absorbing sill is comprised of a member previously subjected to a local deformation for providing a trigger for wall buckling and a plurality of units of such energy absorbing sill are arranged in parallel (or serial and parallel) relation between said cross beams or end sills.

While the present invention is applicable to all kinds of cars inclusive of large-sized cars and high-speed cars, it finds application with more remarkable benefits in streetcars having a comparatively high risk for a collision and particularly in low-floor cars which are relatively more susceptible to damage on collision.

The shock absorbing underframe structure for railroad car use which includes energy absorbing sills disposed between cross beams according to the invention insures a large shock absorbing energy in the event of a collision.

Furthermore, when said reinforcing panel is disposed along the side of the energy absorbing sill, the length of the energy absorbing sill can be fairly increased with lateral buckling effectively prevented, with the result that a sufficient deformation stroke can be provided by the structurally simple contrivance.

Moreover, since the shock energy at colliding of the front end of the car can be remarkably decreased as compared with the conventional structure, the present invention contributes a great deal to the assurance of passenger safety without compromise in the capability to deal with the usual load conditions.

In addition, since various specifications can be easily satisfied by modifying the arrangement and number of energy absorbing sills in the longitudinal and transverse directions of a car, the invention can be applied to various types of railroad cars.

DETAILED DESCRIPTION OF THE PREFERRED EMBODIMENTS

Figure 1:
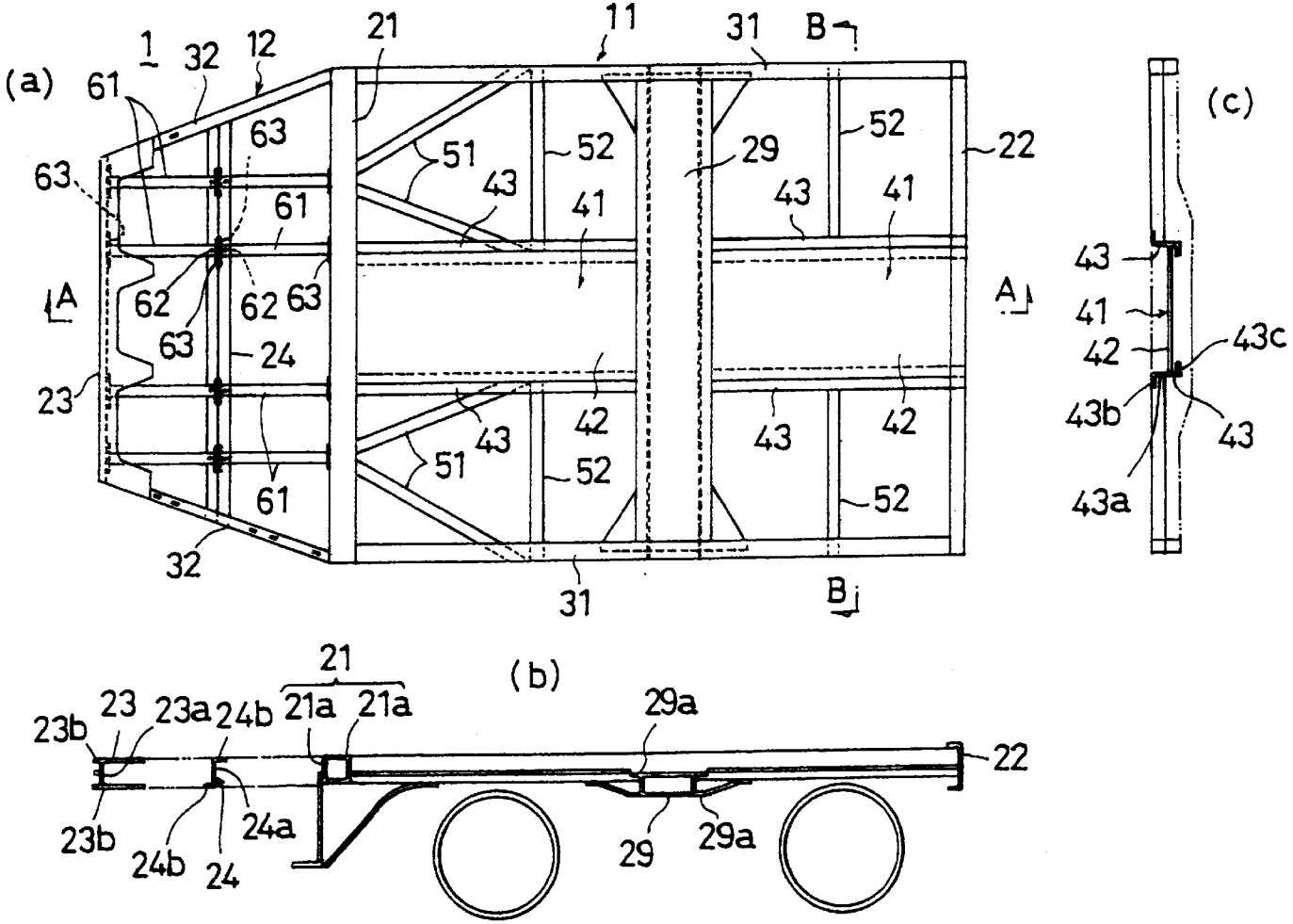
FIG. 1 shows a typical railroad car underframe embodying the shock absorbing underframe design concept of the present invention, wherein (a) is a plan view, (b) a cross-section view taken along the line A—A, and (c) a cross-section view taken along the line B—B.

The shock absorbing underframe structure for railroad car use according to the present invention is characterized in that a plurality of shock absorbing sills extending in the lengthwise direction of a car are disposed and connected in series and/or parallel between cross or end sills disposed in the forward part of a railroad car underframe.

Preferably, reinforcing panels such as aluminum honeycomb panels are disposed along the four sides of each energy absorbing sill to thereby provide for a sufficient wall-buckling deformation stroke in the lengthwise direction while preventing the lateral buckling of the energy absorbing sill despite its extended length. In this construction, therefore, the longitudinal serial connection of individual energy absorbing sills can be omitted or remarkably spared.

The energy absorbing sill is made of a metal, resin or other material having adequate rigidity, yield strength, and ductility. It is characterized in that when the underframe is subjected to an excessively large shock energy on the occasion of a collision or the like accident, the shock energy is chiefly absorbed by the plastic deformation energy due to the wall buckling of the energy absorbing sills.

Thus, in the present invention, a certain part of the front head portion of a car is designated as a destruction region and constituted in an "easily destructible" construction, while the part posteriorly thereof is constituted in a "non-destructible, low-acceleration/deceleration" construction. Since the shock energy is absorbed by the plastic deformation energy arising from deformation of the energy absorbing sills in the "easily destructible" region, the acceleration/deceleration of the posterior part can be remarkably suppressed by the structure yielding a large strain energy.

Generally the plastic deformation energy of an object is given by the product of working load multiplied by deformation stroke. This means that in order to increase absorption energy, either the working load (which is not constant) or the deformation stroke is to be increased.

However, increasing the working load results in the transmission of a large force to the posterior part of the underframe owing to the law of action and reaction and, therefore, cannot be done from the standpoint of protection of the posterior part. Particularly a working load having momentarily large peaks exerts a deleterious effect on the posterior part of the car.

Therefore, in order to efficiently increase the absorption energy, it is effective to introduce a construction providing for a large plastic deformation stroke while the working load is suppressed to a value as constant as possible and close to the critical strength value of the posterior part of the underframe.

From those considerations, the underframe structure of the present invention is characterized in that a plurality of shock absorbing sills providing for a large deformation stroke at a substantially constant working load are arranged in series and/or parallel.

However, generally when an "easily destructible" structure is to be introduced into a car for protection against collision hazards, the "should not be destroyed" load conditions, unrelated to a collision, must be satisfied at the same time in the majority of cases. Thus, the "easily destructible" condition for protection against collision hazards and the condition of "should not be destructible under other conditions" must be reconciled and this has made "easily destructible" designing difficult to this day. The "other conditions" mentioned above include vertical load, end-to-end compression load, torsional load, and car-end lifting load which applies in restoration work after derailment, for instance.

The present invention provides a shock absorbing underframe structure for railroad car use in which the above-mentioned "easily destructible" condition for protection against collision hazards and the "ruggedness" condition for withstanding predetermined magnitudes of said vertical load, end-to-end compressive load, torsional load, car-end lifting load, etc. are reconciled.

The shock energy absorbing sill is made of steel, stainless steel, aluminum alloy, or synthetic resin, for instance, and is generally fabricated by the rolling stock manufacturer or purchased from specialty manufacturers.

The energy absorbing sill is designed to have such characteristics that, when subjected to an axial compressive load, it undergoes wall buckling repeatedly to generate compression strokes at a substantially constant axial compressive load value without undergoing lateral (Euler) buckling. Thus, its sectional profile is determined in such a manner that the axial compressive load value necessary to repeatedly cause wall buckling will be equal to the desired design value.

Moreover, since the greater the original length of the energy absorbing sill is, the longer is the compression stroke, it might be considered reasonable to increase the original length in order to provide for a large plastic strain energy upon compression. However, when its length is greater than a certain limit, the energy absorbing sill undergoes lateral buckling prior to wall buckling so that neither a constant working load nor a sufficiently long deformation stroke can be obtained.

In this sense, the present invention is characterized in that the original length of the energy absorbing sill is divided into short lengths for preventing the above lateral buckling. Thus, another cross beam is disposed between cross or end sills to make the interval of cross beams of the underframe shorter than the critical length of lateral buckling of the energy absorbing sill and the energy absorbing sills are disposed in a continuous linear series between cross beams. In this manner, the necessary compression stroke can be obtained by causing the axial compressive deformation by wall buckling to take place repeatedly without inducing lateral buckling of the energy absorbing sill.

The present invention in another aspect is characterized in that in order to prevent said lateral buckling, reinforcing panels, e.g. aluminum honeycomb panels, are disposed along the upper, lower, and lateral sides of the energy absorbing sill for reinforcing the sill. In this construction, too, a sufficient compression stroke can be obtained by causing the axial compressive deformation by wall buckling to take place repeatedly without inducing the lateral buckling of the energy absorbing sill.

Meanwhile, the region in which the energy absorbing sills are disposed must be the "easily destructible" region because a large compressive deformation takes place in the longitudinal direction on the occasion of a collision. This "easily destructible" region usually cannot be made so long for car interior layout reasons (the passenger compartment cannot be located in the "easily destructible" region) From this point of view, the present invention is characterized in that in order to increase the absorption energy at a short length, energy absorbing sills are disposed in a plurality of parallel rows in the width direction of the car.

Thus, by disposing energy absorbing sills in a plurality of parallel rows between cross beams, the strain energy corresponding to the necessary shock absorption energy is insured. Where necessary, in each parallel row, energy absorbing sills can be arranged in series in the longitudinal direction. In this case, the necessary connection may be made through the cross beam.

The underframe of a car is equipped with longitudinally through-extending side sills at the lower lateral edges of the frame structure in addition to energy absorbing sills. However, the side sill generally has a channel section so that when the sill spacing is equal between energy absorbing sill and side sill, the side sill undergoes lateral buckling under a smaller axial compressive load than the energy absorbing sill with the result that the side sill does not prevent deformation of the energy absorbing sill.

On the other hand, the energy absorbing sill must satisfy the "should not be destructible" load condition for events other than a collision at the same time. Under this load condition (e.g. vertical load, end-to-end compression load, torsional load, or car-end lifting load in restoration work after derailment), a bending moment acts on the energy absorbing sill in addition to the axial compressive force in the same direction as on the occasion of a collision.

The magnitude of the latter (axial compressive force) is of course smaller than the axial compression load applied in the event of a collision. Therefore, by setting the wall buckling start axial compressive force of the energy absorbing sill at a value larger than the "should not be destructible" axial compression load and smaller than the "must be destructible" axial compression load, both requirements can be satisfied.

As to the former (bending moment), a necessary and sufficient flexural rigidity can be insured at the stage of design of the cross section of this energy absorbing sill. Therefore, the energy absorbing sill is designed in a sectional configuration that, under the "should not be destructible" condition, does not give rise to yield failure and lateral buckling due to the bending moment acting on the energy absorbing sill.

Thus, the present invention provides a structure reconciling the "easily destructible-on-collision" requirement with the "ruggedness" requirement for withstanding predetermined magnitudes of vertical load, end-to-end compression load, torsional load, and car-end lifting load, thus contributing to an enhanced passenger safety in the event of a frontal collision of cars.

The shock absorbing underframe structure for railroad car use according to the invention is now described in detail.

FIG. 1 shows a shock absorbing underframe structure 1 according to the first embodiment of the invention, wherein (a) is a plan view, (b) a cross-section view taken along the line A—A, and (c) a cross-section view taken along the line B—B.

The underframe 1 is for the front coach of a low-floor articulated car and the underframe structure of this invention has been applied to the frontal end of the coach.

The underframe 1 comprises a rectangular underframe body 11 and, as disposed at its forward end, a shock absorbing segment 12 adapted to function as a "collision-destructible region".

The underframe body 11 includes cross beams (first cross beam 21 and second cross beam 22) disposed in the width direction of the car at the front and rear ends and the right and left ends of those cross beams are respectively connected to two side sills 31, 31 disposed in the longitudinal direction of the car. The transversely middle parts of those cross beams are interconnected by center sills 41, 41 through a bolster The first cross beam 21 disposed in the transverse direction at the front end of the underframe body 11 consists of two bracket-shaped members 21*a*, 21*a* with the open edges thereof being abutted against each other and jointed together to provide an integral unit having a square cross section.

The second cross beam 22 disposed in the transverse direction at the rear end of the underframe body 11 is a bracket-shaped member which is disposed with its open side facing forward.

The side sills 31, 31 disposed in the longitudinal direction along the right and left edges of the underframe 11 are bracket-shaped members with their open ends facing transversely inward. The side sill 31 is rigidly secured in position with its front end abutted against the rear end of the first cross beam 21 and its rear end received in the bracket-like cavity of the second cross beam 22.

The bolster 29 is disposed in an intermediate position between the first cross beam 21 and second cross beam 22. The bolster 29 is a hollow member having a generally rectangular longitudinal section with its upper and lower ends expanding slightly out of the front and rear edges thereof to form flanges 29*a*. The bolster 29 is rigidly secured at its lateral ends to the right and left side sills 31, 31.

Between the first cross beam 21 and the bolster 29 and between the bolster 29 and the second cross beam 22, center sills 41, 41, both of which are plate-shaped, are disposed in the transversely middle position between the right and left side sills 31, 31. The center sill 41 comprises a rectangular plate member 42 and, as attached to the right and left edges thereof, generally Z-configured auxiliary members 43, 43. The auxiliary member 43 is disposed in such a manner that the top end portion 43*b* of its central wall 43*a*, which is oriented in a vertical direction, is bent transversely outward in the form of the letter L while the lower end portion 43*c* of said central face 43*a* is bent transversely inward in the shape of the letter L, with the vertically central part of said central wall 43*a* being rigidly secured to the right and left edges of said plate member 42. The center sill 41 has its ends connected to either said first cross beam 21 or said second cross beam 22 and said bolster 29 and secured in the transversely middle position of the underframe body 11.

In this manner, the underframe body 11 is provide d with a total of 4 rectangular spaces defined by said cross beams 21, 22, side sills 31, 31, center sills 41, 41, and bolster 29. Furthermore, diagonal sills 51 and reinforcing cross beams 52 are disposed in said spaces. In the illustrated embodiment, the spaces formed in the right and left front zones of the underframe body 11 are respectively traversed by diagonal sills 51, 51 extending from the transversely central and forward position of the space to the side sill 31 and center sill 41, respectively, with an increasing clearance therebetween and an auxiliary cross beam 52 is disposed, in each space, in the manner of bridging the side sill 31 and center sill 41 at the rearmost ends of the diagonal sills. On the other hand, the spaces formed in the right and left rear zones of the underframe body 11 are respectively traversed by an auxiliary cross beam 52 bridging the side sill 31 and center sill 41 in the longitudinally central position. As the diagonal sills 51 and reinforcing cross beams 52, bracket-shaped members having the same sectional configuration are employed.

The shock absorbing segment 12 is formed in a trapezoidal configuration in plan view at the forward end of the underframe body 11. In the illustrated embodiment, the shock absorbing segment 12 comprises an end sill 23, which is slightly shorter than said first cross beam 21, as disposed centrally and forwardly of said first cross beam 21 in parallel therewith and a couple of side sills 32, 32 connecting the ends of said end sill 23 to the right and left ends of the first cross beam 21, respectively.

The end sill 23 is a sectioned member formed with a couple of flanges 23*b* extending longitudinally outward at the upper and lower ends of its vertically oriented central wall 23*a* and forwardly projecting flanges 23*b* in the intermediate part of said central wall 23*a*. On the other hand, the side sills 32 are bracket-shaped members.

In the shock absorbing segment 12 thus formed in a trapezoidal configuration in plan view, a suitable number of energy absorbing sills 61 are arranged in parallel and series according to the specification.

Figure 2:
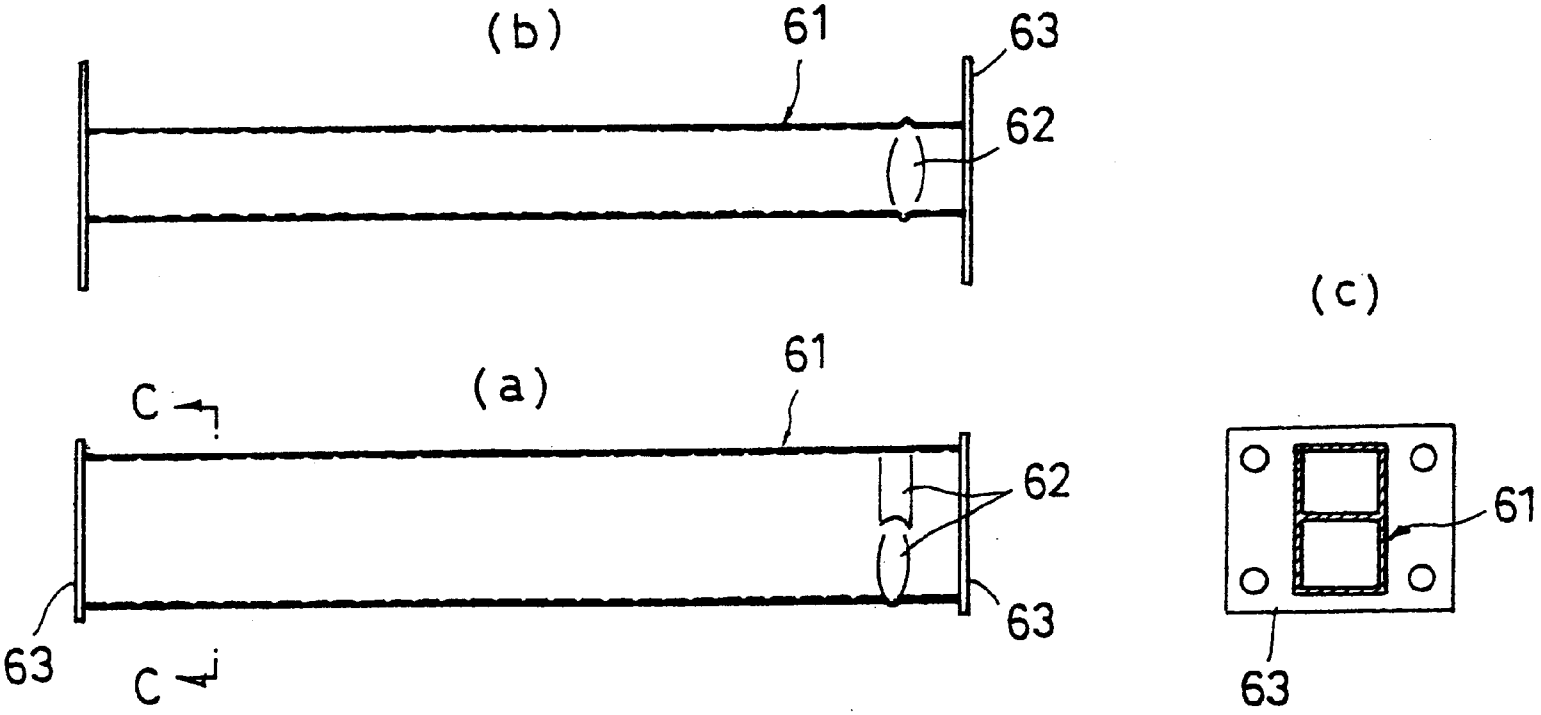
FIG. 2 shows a typical energy absorbing sill for the underframe illustrated in FIG. 1, wherein (a) is a front view, (b) a plan view, and (c) a cross-section view taken along the line C—C.
Figure 3:
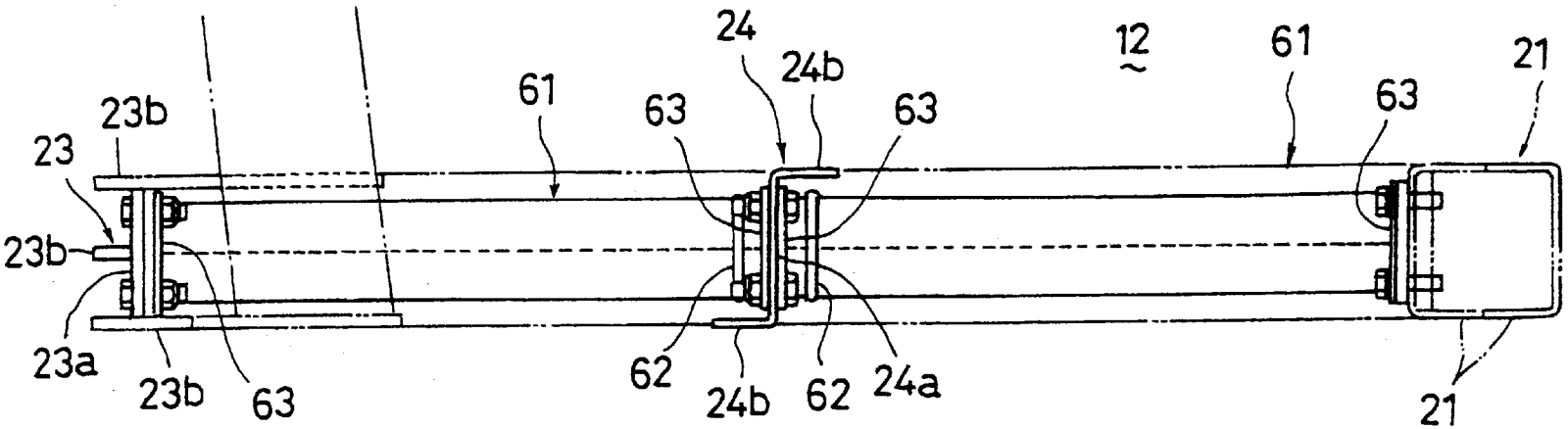
FIG. 3 is a longitudinal cross-section view on exaggerated scale showing the transversally middle part of the shock absorbing segment of the underframe illustrated in FIG. 1.

As the energy absorbing sill 61, the one illustrated in FIG. 2 as an example is used. In FIG. 2 showing the energy absorbing sill 61, (a) is a front view, (b) a plan view, and (c) a cross-section view taken along the line C—C. FIG. 3 is a longitudinal section view of the transversely central zone of the shock absorbing segment 12.

The energy absorbing sill 61 is a member which, on compression in the longitudinal direction, undergoes wall buckling, that is bellows-like deformation of the wall surface, without undergoing lateral or Euler buckling. Such wall buckling requires a comparatively large load (maximum load) for producing a first wall buckling episode in an early phase of compression but once the first episode of wall buckling has taken place, subsequent wall buckling events take place serially at loads smaller than said maximum load (though dependent on the material and sectional configuration, loads corresponding to about ½ through ⅓ of the maximum load) although the magnitude of load varies in an undulating fashion, thus producing a bellows-like deformation. In this connection, if the energy absorbing sill 61 is preloaded with a local deformation (trigger) 62 serving as a cue to deformation, the maximum load in the early phase of compression can be decreased.

Therefore, as the energy absorbing sill 61 for this embodiment, an extruded aluminum alloy member in a bridged quadrangular sectional configuration is longitudinally pre-compressed to induce one pitch equivalent of bellows-like deformation, thus producing said cue or trigger 62. The trigger 62 in the energy absorbing sill 61 can be formed in a substantially constant position by an appropriate stress-loading procedure although slight variations are inevitable. In the illustrated embodiment, the trigger 62 is formed in a position close to one end of the member having a bridged quadrangular sectional configuration.

In this embodiment, a series of two energy absorbing sills 61 is disposed in 4 rows.

Thus, in a position intermediate between the end sill 23 and the first cross beam 21, a fourth cross beam 24 is disposed transversely bridging the right and left side sills 32, 32, and four energy absorbing sills 61 are disposed between said fourth cross beam 24 and end sill 23 and between said fourth cross beam 24 and first cross beam 21, respectively.

The fourth cross beam 24 is a member having a sectional configuration approximating the letter Z.

Thus, the upper and lower edges 24*b*, 24*b* of its vertically oriented central wall 24*a* are bent respectively in the form of the letter so as to staggeredly project in either the forward or the backward direction.

The respective energy absorbing sills 61 as installed are extending symmetrically over equal distances from the transversely central position of the shock absorbing segment 12 with the front and rear energy absorbing sills 61, 61 of each set being disposed in alignment. Specifically, as illustrated in FIGS. 1 and 3, the plate members 63, 63 disposed at both ends of the energy absorbing sill 61 are rigidly secured, by bolt means, to the end sill 23, the fourth cross beam 24 or the first cross beam 21.

The load per sill which is required for causing wall buckling of said energy absorbing sill 61 is set judicially according to the material, sectional area and configuration, and other factors, but the load setting per sill in the illustrated embodiment is 12 tons. On the other hand, the maximum shock load which can be tolerated by the underframe 1 (12) is dependent on the type of car. However, taking a streetcar as an example, the maximum load setting is usually about 30~100 tons. In this embodiment wherein energy absorbing sills 61 are arranged in 4 parallel rows transversally spaced apart, the load is set at about 50 tons (12 tons/sill×4=48 tons). Thus, the specification here is that no destruction should occur at 45 tons but destruction should occur at 50 tons. Furthermore, in order to provide for a sufficient stroke in the forward and back direction, the two energy absorbing sills 61 in each row are interconnected in series through the fourth cross beam 24.

In accordance with this invention described above, the maximum shock load which can be tolerated by the underframe 1 (12) and the plastic strain energy (load×deformation stroke) required for absorbing a collision shock energy can be adjusted by varying the number of energy absorbing sills 61 and the serial and parallel arrangement of the sills 61. In other words, the underframe structure of the invention can be tailored to various kinds of cars by adjusting the number and layout of energy absorbing sills 61.

Figure 4:
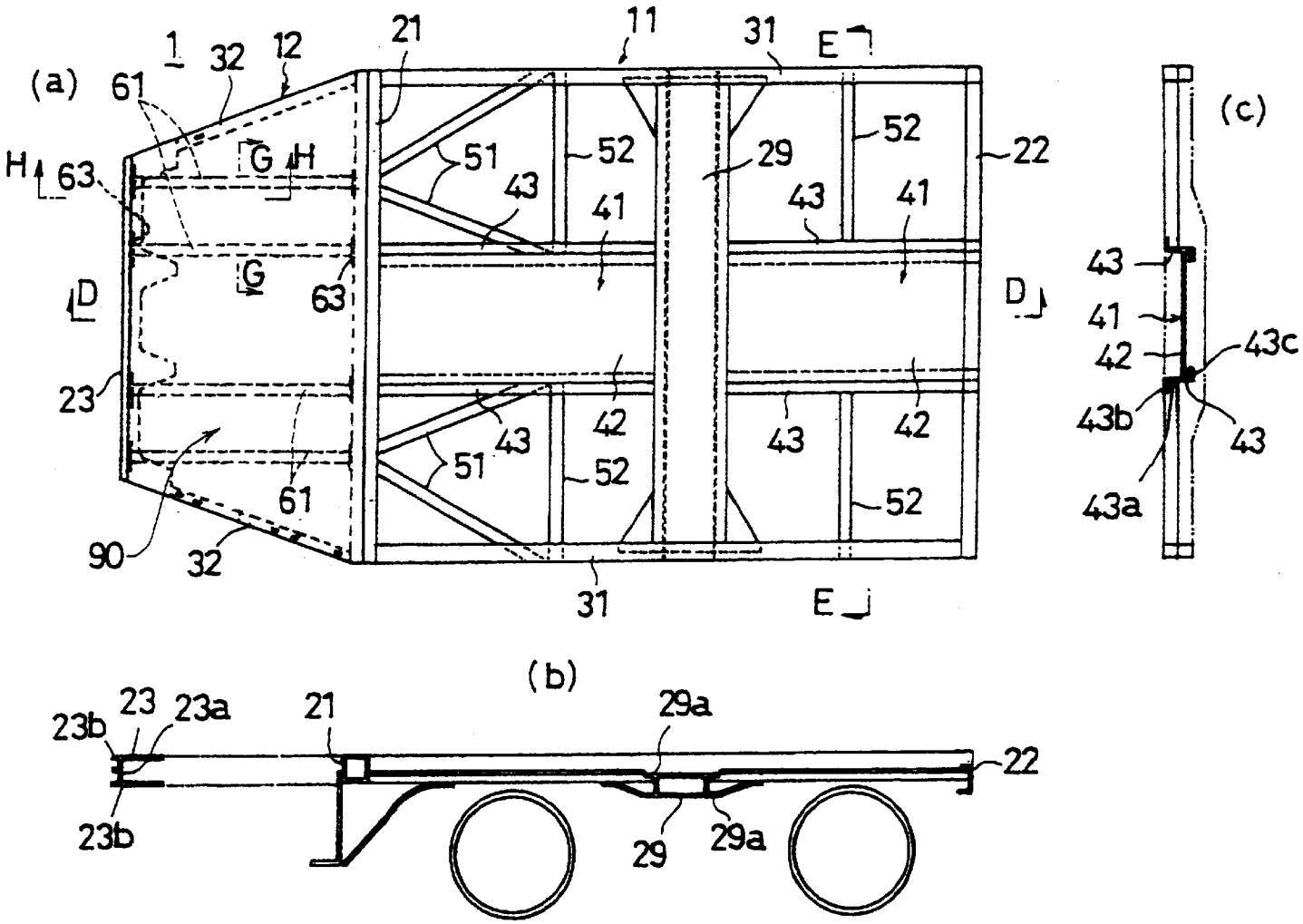
FIG. 4 shows another railroad car underframe embodying the shock absorbing underframe design concept of the invention, wherein (a) is a plan view, (b) a cross-section view taken along the line D—D, and (c) a cross-section view taken along the line E—E.

FIG. 4 shows a shock absorbing underframe structure for railroad car according to a second embodiment of the invention, wherein (a) is a front view, (b) a cross-section view taken along the line D—D, and (c) a cross-section view taken along the line E—E.

Figure 5:
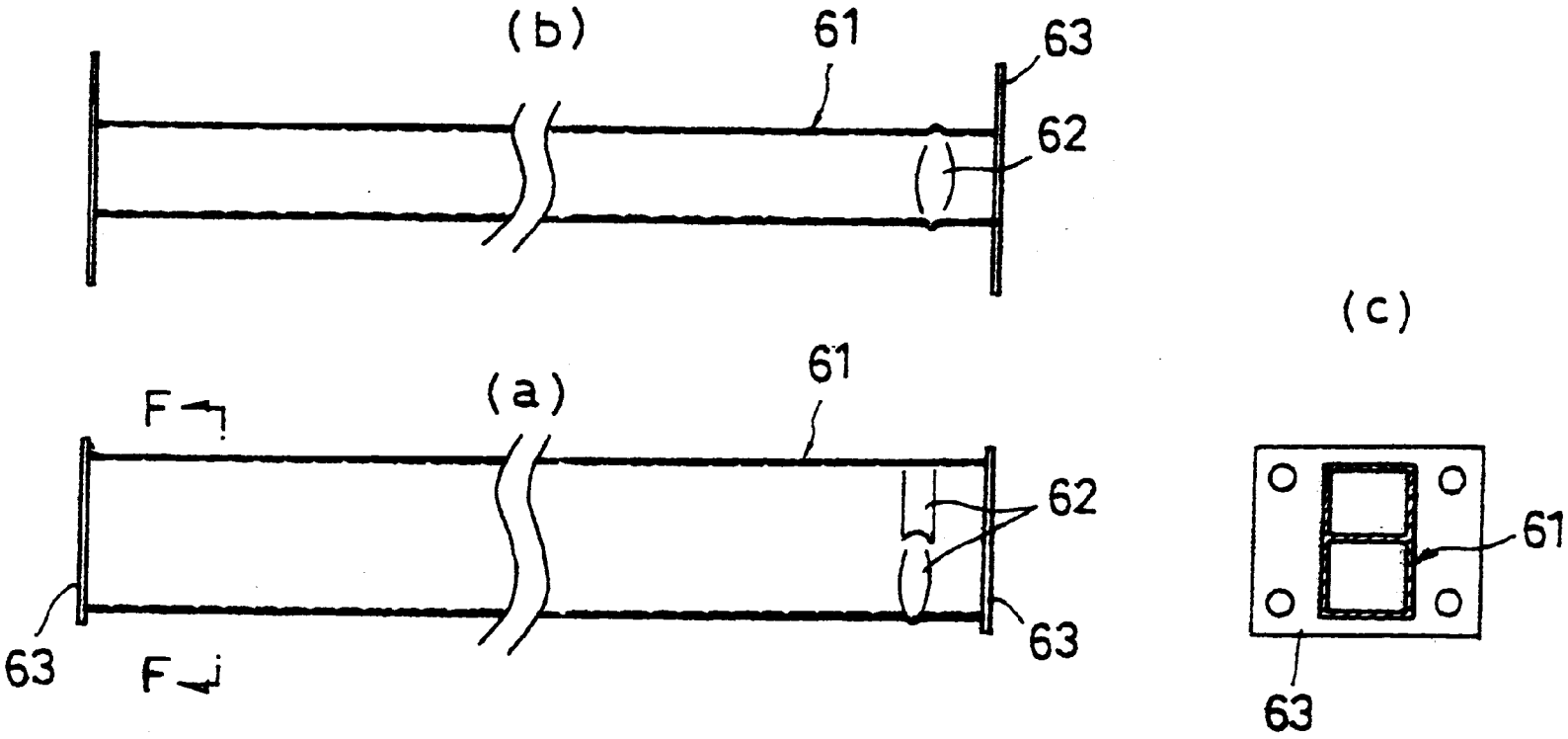
FIG. 5 shows a typical energy absorbing sill for the underframe illustrated in FIG. 4, wherein (a) is a front view, (b) a plan view, and (c) a cross-section view taken along the line F—F.
Figure 6:
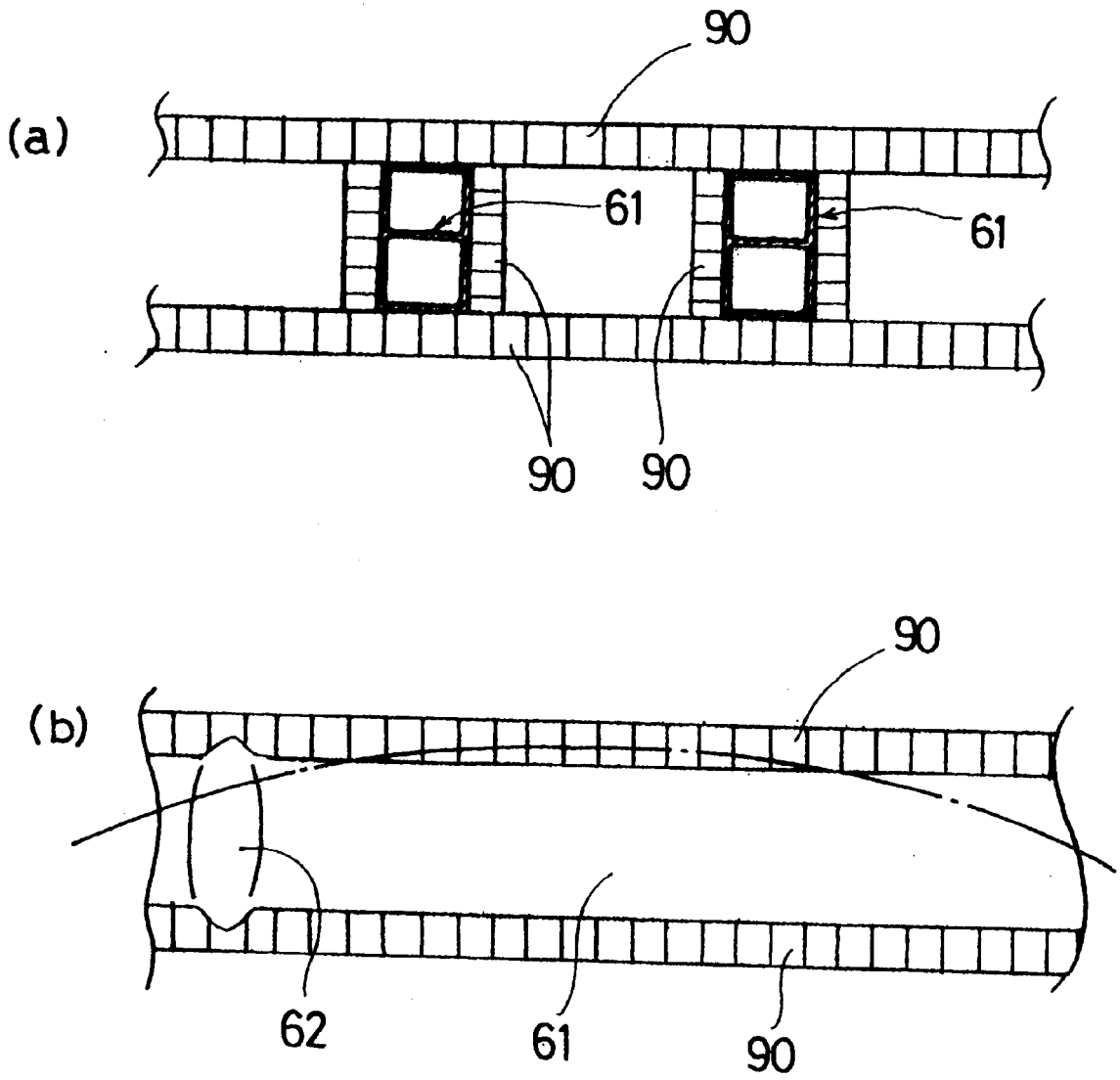
FIG. 6 is a schematic longitudinal cross-section view of the shock absorbing segment of the underframe illustrated in FIG. 4, wherein (a) is a cross-section view of the shock absorbing segment taken along the line G—G and (b) is a longitudinal section view taken along the line H—H.

FIG. 5 shows the energy absorbing sill 61 for this embodiment, wherein (a) is a front view, (b) a plan view, and (c) a cross-section view taken along the line F—F. FIG. 6 is a schematic longitudinal section view of the shock absorbing segment 12, wherein (a) is a longitudinal section view of the shock absorbing segment 12 (taken along the line G—G of FIG. 4) and (b) is a longitudinal section view of the same shock absorbing segment 12 (taken along the line H—H of FIG. 4).

The underframe structure of this embodiment is fundamentally identical with the underframe structure so far described with reference to the first embodiment and, therefore, only the differences are now described.

The underframe structure 1 of this embodiment also comprises a rectangular underframe body 11 and, as disposed at its forward end, a shock absorbing segment 12 which functions as a destruction zone in the event of a collision. The construction of the underframe body 11 is identical with that of the first embodiment except that the first cross beam 21 transversely disposed at the forward end of the body is a member having a square sectional configuration.

In this second embodiment, four energy absorbing sills 61 are arranged in parallel. Here, the longitudinal dimension of the energy absorbing sill is greater than the corresponding sill in the first embodiment, e.g. about twice the length of the latter.

Thus, the four energy absorbing sills 61 are arranged in parallel bridging the end sill 23 and first cross beam 21.

The respective energy absorbing sills 61 are disposed symmetrically over equal distances about the transverse center of the shock absorbing segment 12. The shock absorbing sill 61 is rigidly secured in position with its plates 63, 63 at front and rear ends being fixed, by bolt means, to the end sill 23 and first cross beam 21, respectively.

In this embodiment, a sufficient deformation stroke in the longitudinal direction is secured by increasing the length of each energy absorbing sill 61. In this arrangement, the number of connecting energy absorbing sills 61 in series can be decreased. In the illustrated example, no longitudinal serial connection is used.

Prolonging the energy absorbing sill 61 increases the risk for lateral buckling prior to onset of wall buckling but, in this invention, the onset of lateral buckling is precluded by disposing reinforcing panels 90 along the sides of each energy absorbing sill 61.

In this embodiment, the reinforcing panel 90 is an aluminum honeycomb panel. The reinforcing panel 90 is comparatively weak in the longitudinal direction of the energy absorbing sill 61 but highly resistant to bending (resistant to the deflection indicated by a dot-dash line in FIG. 6(*b*)). Therefore, as the reinforcing panels 90 are disposed around the energy absorbing sill 61, the radial displacement of the energy absorbing sill 61 can be prevented and, as a result, the lateral buckling of the energy absorbing sill 61 can be prevented.

Specifically, a rectangular reinforcing panel 90 is longitudinally disposed along each side of the energy absorbing sill 61 in intimate contact therewith and, in addition, generally trapezoidal reinforcing panels 90 are disposed to cover the top and bottom of the shock absorbing segment 12 so that the top and bottom sides of the energy absorbing sill 61 are also similarly reinforced.

The right and left reinforcing panels 90, 90 on the lateral sides of the energy absorbing sill 61 are rigidly secured to the sill 61 by riveting, bonding or the like means. The top and bottom reinforcing panels 90, 90 disposed on the upper and lower sides of the shock absorbing segment 12 are fixed in position as the respective front and back edges are secured to the end sill 23 and first cross beam 21 by screw means.

Energy absorbing sills may be arranged not only transversely in parallel but also longitudinally in series but in accordance with this embodiment wherein the deformation stroke of an energy absorbing sill can be comparatively long, the number of sills to be installed in series can be considerably decreased.

In the above embodiments, an excluded aluminum alloy member having a bridged quadrangular sectional configuration is used for the energy absorbing sill 61 but both the material and shape of the energy absorbing sill 61 can be freely modified. For example, the energy absorbing sill 61 need not be made of aluminum alloy but may be made, for example, of steel, stainless steel or synthetic resin. Regarding the shape of energy absorbing sill 61, it is not only possible to modify the length and profile but various other sectional patterns than said bridged quadrangular configuration, for example the profile of a hat, can be adopted. The shape of the trigger 62 is not limited to the illustrated one, either, but may for example be a pressed-in dent or notch.

What is claimed is:

1. A shock absorbing underframe structure for railroad car use comprising at least two of cross or end sills transversely disposed in parallel and longitudinally spaced apart relation at the front end of a railroad car underframe and energy absorbing sills adapted to absorb shock energy by undergoing wall buckling when subjected to a shock load over a predetermined value from the front end of the car as disposed between said cross or end sills wherein said predetermined value of shock energy is variable according to the number and arrangement of said energy absorbing sills; wherein said energy absorbing sills are respectively provided with a reinforcing panel on an upper, lower and each lateral side thereof, and said reinforcing panels include aluminum honeycomb panels that are weak in the longitudinal direction of the energy absorbing sill, but highly resistant to lateral bending.

2. The shock absorbing underframe structure for railroad car use according to claim 1 wherein each of said energy absorbing sills is a member preloaded with a local deformation providing a trigger for wall buckling, a plurality of units of said member being disposed in parallel between said cross or end sills.

3. The shock absorbing underframe structure for railroad car use according to claim 1 wherein the railroad car is a low-floor articulated car.

4. A shock absorbing underframe structure for railroad car use comprising at least two of cross or end sills transversely disposed in parallel and longitudinally spaced apart relation at the front end of a railroad car underframe and energy absorbing sills adapted to absorb shock energy by undergoing wall buckling when subjected to a shock load over a predetermined value from the front end of the car as disposed between said cross or end sills wherein said predetermined value of shock energy is variable according to the number and arrangement of said energy absorbing sills; wherein said energy absorbing sills are surrounded by reinforcing panels and said reinforcing panels include aluminum honeycomb panels that are weak in the longitudinal direction of the energy absorbing sill, but highly resistant to lateral deformation.

5. The shock absorbing underframe structure for railroad car use according to claim 4 wherein each of said energy absorbing sills is a member preloaded with a local deformation providing a trigger for wall buckling, a plurality of units of said members being disposed in a parallel between said cross or end sills.

6. The shock absorbing underframe structure for railroad car use according to claim 4 wherein the railroad car is a low-floor articulated car.

* * * * *